United States Patent [19]

Blakeslee et al.

[11] 4,440,609

[45] Apr. 3, 1984

[54] METHOD OF ELECTRODEPOSITING A LOW COERCINE FORCE, CORROSION-RESISTANT ALLOY OF NICKEL, IRON AND BORON

[75] Inventors: Marybelle C. Blakeslee, Golden, Colo.; Judith D. Olsen, Golden's Bridge; Lubomyr T. Romankiw, Briarcliff Manor, both of N.Y.

[73] Assignee: International Business Machines Corporation, Armonk, N.Y.

[21] Appl. No.: 493,499

[22] Filed: May 11, 1983

Related U.S. Application Data

[62] Division of Ser. No. 221,598, Dec. 31, 1980, abandoned.

[51] Int. Cl.[3] ..... C25D 3/56

[52] U.S. Cl. ..... 204/43 T

[58] Field of Search ..... 204/43 T, 123; 106/1.22

[56] References Cited

U.S. PATENT DOCUMENTS 3,483,029 12/1969 Koretzky et al. .

3,485,725 12/1969 Koretzky .

OTHER PUBLICATIONS

W. O. Freitag et al., J. Electrochem. Soc., III, No. 1, pp. 35–39, (Jan. 1964).

*Primary Examiner*—G. L. Kaplan

*Attorney, Agent, or Firm*—Joseph G. Walsh

[57] ABSTRACT

The present invention deals with alloys consisting essentially of the elements nickel, iron and boron. Boron is present at from 0.1 to 2.0% by weight; iron is present from 17 to 27% by weight and the balance is nickel. The alloy has high resistance to corrosion and $H_o$ and $H_c$ are less than 0.1 Oe in films 3000Å thick. It is prepared by electrodeposition from a bath having a pH of 2.5 or less, and containing a borane reducing agent.

3 Claims, No Drawings

METHOD OF ELECTRODEPOSITING A LOW COERCINE FORCE, CORROSION-RESISTANT ALLOY OF NICKEL, IRON AND BORON

This application is a divisional application of U.S. Ser. No. 06/221,598, filed Dec. 31, 1980 and now abandoned.

DESCRIPTION

1. Technical Field

The present invention deals with alloys consisting essentially of the elements nickel, iron and boron, and with the process for their preparation. The alloys have very high resistance to corrosion and exceptionally low coercive force. Both $H_O$ and $H_C$ are less than 0.1 Oe in films 3000 Å thick.

2. Background Art

U.S. Pat. No. 3,483,029 of Koretzky et al for "Method and Composition for Depositing Nickel-Iron-Boron Magnetic Films" describes in the Example an NiFeB electrolessly deposited alloy with 0.8% B, 19.3% Fe and the remainder Ni. The film was 12,550 Å thick and had a coercivity of $H_O=1.0$ c. The magnetostriction was near zero. The anisotropic field was about 4.8 Oe. The pH of the bath was above 8. Low coercivity was not achieved.

U.S. Pat. No. 3,485,725 of Koretzky entitled "Method of Increasing the Deposition Rate of Electroless Solutions" mentions the use of a small electrical current passed through an electroless plating bath for the purpose of increasing the rate of deposition. The patent relates to ferromagnetic films. The bath used hypophosphite anions and metal cations such as nickel, iron or cobalt and their alloys. The pH was about 7.8. Low coercivity was not achieved.

Freitag et al, "The Electrodeposition of Nickel-Iron Phosphorous Thin Films for Computer Memory Use," *Journal of the Electrochemical Society* III, No. 1, 35–39 (Jan. 1964) described a 2% P, Ni-Fe-P film with an $H_c$ of 1.4 Oe and $H_k$ of 2.9 Oe, which makes it clear that phosphorous did not produce low value of $H_c$.

DESCRIPTION OF THE INVENTION

The present invention provides alloys of increased resistance to corrosion and extremely low coercivity. The alloys consist essentially of nickel-iron and boron with the boron being present in an amount of approximately 0.1 to 2% by weight. It is preferred that the iron content be between 17% and 27%, with the balance Ni. The alloys according to the present invention, have $H_o$ and $H_c$ of less than 0.1 Oe in films 3000 Å thick or thicker. The alloys of the present invention also have excellent magnetic anisotropy.

BEST MODE FOR CARRYING OUT THE INVENTION

The alloys of the present invention are preferably made by electrodeposition from an acid (pH below 2.5) bath containing small amounts of a borane reducing agent such as Dimethylamine borane. Table I below shows a typical bath formulation.

TABLE I

| | G/L | Range |
|---|---|---|
| $NiCl_2.6H_2O$ | 109.0 | 25 to 218 g/l |
| $H_3BO_3$ | 25.0 | 15 to 50 g/l |
| Na saccharin | 1.0 | 0.8 to 3.0 g/l |

TABLE I-continued

| | G/L | Range |
|---|---|---|
| Na lauryl $SO_4$ | 0.6 | 0.2 to 1.0 g/l |
| adjust to pH 1.5, then add $FeCl_2.4H_2O$ | 1.9 | 0.1 to 3.0 g/l |

The dimethylamine borane (DMAB) is predissolved in 100 cc $H_2O$. 1.6 g/l is near maximum solubility in our bath. Range 0.9 to 2.0 g/l. The sodium lauryl $SO_4$ is a surfactant, which improves plating. The sodium saccharin serves to reduce stress in the plated film. The boric acid serves as a pH regulator and deposit brightener.

Agitation of 1 cycle/second in a paddle cell (Ref. 3) is the equivalent of 200 rpm on a rotating disc electrode. $\lambda=0$ at 16.5 mA/cm$^2$ when $FeCl_2.4H_2O=1.9$ g/l. Agitation rate anywhere from 0.5 cycle per second to 2 cycles per second can be utilized.

After the addition of DMAB solution to the bath, the pH rises for a few minutes. After readjusting the pH to 2.5 the bath is usable. If the concentration of $FeCl_2.4H_2O$ is higher than 1.9 g/l, the current will have to be raised in order to maintain the $\lambda=0$ composition. For example, if the $FeCl_2.4H_2O$ is increased to 5.0 g/l, $\lambda=0$ is obtained at 49.6 mA/cm$^2$ when plating onto a cathode in a continuous sheet form. At this high current density the DMAB seems to have a smaller effect on the film. When plating is conducted at low density, the resulting films incorporate 2% boron. Despite this small quantity of boron, the magnetic behavior of the film is remarkedly improved. The films also have excellent anisotropy.

A NiFeB film of the present invention having the thickness 5400 Å plated on 1000 Å platinum/100 Å titanium on glass had a value for $H_o$ or 0.1 or less. The instrument commonly used to measure the magnetic properties of NiFe films is not sufficiently sensitive to measure values at this very low level.

When the NiFeB alloy of the present invention is plated on T and I bars, or when a sheet film with $H_o=0.1$ is shaped by ion milling or sputter etching, the superiority in $H_c$ of NiFeB over NiFe is still apparent. This makes the NiFeB quite useful for bubble memory applications. When plating through masks, we also discovered to our surprise that the deposits of NiFeB are smoother and the thickness of individual features over a large area are considerably more uniform than for NiFe. This suggests that in addition to providing boron incorporated in the film, DMAB acts as a smoothing agent and a leveling agent.

While the above example employed dimethylamine borane, it should be apparent to those skilled in the art that other borane containing compounds, particularly borane reducing agents, may be used to obtain similar results. Other useful compounds include, for example, amine boranes such as trimethylamine borane, and other aliphatic heterocyclic, arylamine and heteroaromatic boranes and borohydrides.

EXAMPLES OF FILMS PLATED ONTO A CONTINUOUS SHEET METAL CATHODE

Films were electroplated at room temperature in a >40 oe magnetic field from the bath as shown in Table I onto a cathode in a continuous sheet form except for the following changes:

(a) $FeCl_2.4H_2O$ was 1.6 g/l

DMAB 1.2 g/l and current density id was 5.0 ma/cm$^2$

The resulting 4000 Å thick film had $H_c<0.1$ oe, had very square B-H loop. Film composition was 19% FE, 0.6% B; 80.2% Ni. The film was zero magnetorestrictive ($\lambda=0$).

(b) $FeCl_2.4H_2$ was 1.8 g/l
DMAB was 1.5 g/l
current density is 10 ma/cm$^2$

The composition of the 4000 Å film was 19.4% Fe, 0.4% B and 80.2% Ni. Magnetic results were substantially the same as in (a) above.

(c) $FeCl_2.4H_2O$ was 1.8 g/l
DMAB was 1.5 g/l
current density 21.6 ma/cm$^2$

The composition of the 4000 Å film was 21.6% Fe, 0.3% B and 78.1% Ni. Magnetic properties substantially the same as in (a) above. Film was slightly off from zero magnetostriction.

EXAMPLES OF FILMS PLATED THROUGH PHOTORESIST MASKS (a) Discrete features were plated onto a continuous thin metallizing starter sheet cathode on top of a garnet coated with 3000 Å of $SiO_2$ spacer and on top of Si wafer with 3000 Å $SiO_2$ masked by Shipley 1350 resist with 2 μm wide features exposed in resist to define the bubble memory C- and I-bar and chevron pattern.

The bath composition was:
$NiCl_2$—109 g/l
$H_3BO_3$—25 g/l
Na saccharin—1 g/l
Na lauryl sulfate—0.1 g/l
$FeCl_2.4H_2O$—1.5 g/l
DMAB—was varied from 0 to 2 g/l
the overall id was varied from 3.48 to 5 ma/cm$^2$.

The film compositions were:

| | DMAB g/l | id ma/cm$^2$ | % Fe | % B | % Ni |
|---|---|---|---|---|---|
| (a) | 0 | 5.0 | 21 | 0 | 79 |
| (b) | 1.0 | 5.0 | 25 | 0.4 | 74.6 |
| (c) | 1.0 | 3.5 | 27 | 0.4 | 72.6 |

In both cases where the DMAB was added to the solution the films were smoother; the thickness of various features showed less variation from spot to spot on the wafer; the coercive force of the features was much lower than in the features plated without the boron, and the garnet devices showed lower operative margins of the magnetic field. The operative margin was much lower than in devices plated in absence on DMAB in the bath (a) when DMAB was added to both (b) and (c) to solution % iron in the features, plated through a mask, was always higher than in absence of DMAB.

(b) Discrete features were plated onto a continuous thin film metallizing stater sheet on $SiO_2$ on a garnet and on 3000 Å of $SiO_2$ on Si wafers through 2μ openings in shipley 1350 resist.

The bath composition was:
$NiCl_2.6H_2O$—109 g/l
$H_3BO_3$—25 g/l
Na Saccharin—1.0 g/l
Na Lauryl Sulfate—0.6 g/l
$FeCl_2.4H_2O$—1.1 g/l
DMAB—varied 1.6 to 2.2 g/l
Overall current density varies 5 to 7.0 ma/cm.

Film compositions were:

| DMAB | id | % Fe | % B | % Ni |
|---|---|---|---|---|
| 1.6 | 5 | 17 | 0.4 | 82.6 |
| 1.6 | 7 | 19 | 0.4 | 80.6 |
| 2.2 | 7 | 22 | 0.4 | 77.6 |

Films were plated 3500 Å thick.

In all cases the films have shown superior surface smoothness, superior uniformity of thickness from feature to feature, very low closed loop coercive force and the bubble devices plated on garnets operated at much lower minimum operating bias field.

The minimum bias field in absence of the B in the 3500 Å film plated in 2 μm wide features is on the order of 25 to 30 oe, while for the same thickness film plated from the above bath containing Boron the minimum bias field is consistently 15 oe or lower.

(c) Discrete features were plated onto a continuous thin film metallizing starter sheet on $SiO_2$ on a garnet and on 3000 Å $SiO_2$ on top of Si wafers through 2 μm openings of the C- and I-Bar bubble pattern in Shipley 1350 resist mask.

The bath composition was:
$NiCl_2.6H_2O$—109 g/l
$H_3BO_3$—25 g/l
Na Saccharin—1.0 g/l
Na Lauryl Sulfate—0.6 g/l
$FeCl_2.H_2O$—1.2 g/l
DMAB—varied 0 to 1.2 g/l
overall current density id varied 3.6 to 7.2 ma/cm$^2$.

The resulting 3500 Å plated features had the following characteristics:

| DMAB g/l | id ma/cm$^2$ | % Fe | % B | % Ni |
|---|---|---|---|---|
| 0.0 | 5.0 | 18 (varied 18.3 to 19.5) | 0 | 82 |
| 0.4 | 7.2 | 20 | ~0.4 | 79.6 |
| 1.0 | 3.6 | 24 | ~0.4 | 75.6 |
| 1.2 | 5.0 | 25 | ~0.4 | 74.6 |

All films in which DMAB was used showed superior smoothness, superior thickness uniformity from feature to feature and superior magnetic characteristics. The bubble memory devices plated with these films on garnet showed much lower value of the lower operating margin of the bubble devices.

Corrosion testing of all films plated from the bath containing DMAB, and hence containing B in addition to Ni and Fe, showed 4 to 10 times higher corrosion resistance than the films plated from the above bath in absence of DMAB.

We claim:

1. A process for electrodepositing an alloy of high corrosion resistance and $H_o$ and $H_c$ of less than 0.1 Oe in films 3000 Å thick, said process comprising electrodepositing nickel-iron and boron from an acid bath of pH at or below 2.5 which comprises a borane reducing agent, with the deposited alloy containing approximately 0.1 to 2% by weight boron, from 17% to 27% by weight iron, and the balance nickel.

2. A process as claimed in claim 1 wherein the borane reducing agent is dimethylamine borane.

3. A process as claimed in claim 1 wherein the bath also contains a pH regulator, a surfactant and sodium saccharin.

* * * * *